US007953584B2

(12) United States Patent
Rashid

(10) Patent No.: US 7,953,584 B2
(45) Date of Patent: May 31, 2011

(54) METHOD FOR OPTIMAL LIFT GAS ALLOCATION

(75) Inventor: Kashif Rashid, Hounslow (GB)

(73) Assignee: Schlumberger Technology Corp, Houston, TX (US)

( * ) Notice: Subject to any disclaimer, the term of this patent is extended or adjusted under 35 U.S.C. 154(b) by 757 days.

(21) Appl. No.: 11/711,373

(22) Filed: Feb. 27, 2007

(65) Prior Publication Data

US 2008/0154564 A1 Jun. 26, 2008

Related U.S. Application Data

(60) Provisional application No. 60/873,429, filed on Dec. 7, 2006.

(51) Int. Cl.
*G06G 7/48* (2006.01)

(52) U.S. Cl. ..... 703/10; 166/372; 166/336; 166/52; 166/369; 166/265; 73/152.02; 73/152.21; 73/152.15

(58) Field of Classification Search ..... 703/10; 702/6, 189; 166/263, 52, 250.03
See application file for complete search history.

(56) References Cited

U.S. PATENT DOCUMENTS

| | | | | |
|---|---|---|---|---|
| 5,176,164 | A | 1/1993 | Boyle | |
| 5,782,261 | A | 7/1998 | Becker | |
| 5,871,048 | A * | 2/1999 | Tokar et al. | 166/263 |
| 5,992,519 | A | 11/1999 | Ramakrishnan | |
| 6,178,815 | B1 | 1/2001 | Felling | |
| 6,206,645 | B1 | 3/2001 | Pringle | |
| 6,313,837 | B1 | 11/2001 | Assa | |
| 6,775,578 | B2 | 8/2004 | Couet | |
| 6,840,317 | B2 | 1/2005 | Hirsch | |
| 6,980,940 | B1 * | 12/2005 | Gurpinar et al. | 703/10 |
| 7,114,557 | B2 * | 10/2006 | Cudmore et al. | 166/52 |
| 7,248,259 | B2 | 7/2007 | Fremming | |
| 2003/0094281 | A1 * | 5/2003 | Tubel | 166/250.03 |
| 2003/0216897 | A1 | 11/2003 | Endres | |
| 2004/0104027 | A1 | 6/2004 | Rossi | |
| 2004/0220846 | A1 | 11/2004 | Cullick | |
| 2005/0149264 | A1 * | 7/2005 | Tarvin et al. | 702/6 |
| 2005/0149307 | A1 * | 7/2005 | Gurpinar et al. | 703/10 |
| 2006/0076140 | A1 | 4/2006 | Rouen | |
| 2006/0197759 | A1 | 9/2006 | Fremming | |

(Continued)

FOREIGN PATENT DOCUMENTS

| | | |
|---|---|---|
| WO | 9964896 | 12/1999 |
| WO | 2004049216 | 6/2004 |

OTHER PUBLICATIONS

Calum McKie et al. New Mathematical Techniques for the Optimisation of Oil & Gas Production Systems SPE 2000. WPE 65161.*

(Continued)

*Primary Examiner* — David Silver
*Assistant Examiner* — Cuong V Luu
(74) *Attorney, Agent, or Firm* — Robert P. Lord; Jim Patterson; Bryan Galloway

(57) ABSTRACT

A method is disclosed for optimal lift gas allocation, comprising: optimally allocating lift gas under a total lift gas constraint or a total produced gas constraint, the allocating step including distributing lift gas among all gas lifted wells in a network so as to maximize a liquid or oil rate at a sink.

15 Claims, 8 Drawing Sheets

U.S. PATENT DOCUMENTS

| | | | | |
|---|---|---|---|---|
| 2007/0112547 | A1 | 5/2007 | Ghorayeb | |
| 2007/0239402 | A1 * | 10/2007 | Scott | 702/189 |
| 2007/0246222 | A1 | 10/2007 | Ramachandran | |
| 2008/0140369 | A1 | 6/2008 | Rashid | |
| 2009/0198478 | A1 | 8/2009 | Cuevas | |

OTHER PUBLICATIONS

Schlumberger, "Pipesim, Pipeline and facilities design and analysis", Schlumberger Information Solutions Brochure No. SIS__02__0231__0, Jan. 2003.

Schlumberger, "Pipesim, Well design and production performance analysis", Schlumberger Information Solutions Brochure No. SIS__02__0232__0, Jan. 2003.

Schlumberger, "Avocet Gas Lift Optimization Module", Schlumberger Brochure No. 08-IS-298, 2008.

Schlumberger, "Avocet, Integrated Asset Modeler", Schlumberger Brochure No. 05-IS-246, 2005.

Petroleum Experts, "IPM—Gap, Prosper, MBAL, PVTP, Reveal, Resolve, Openserver", 2008.

* cited by examiner

FIG. 11
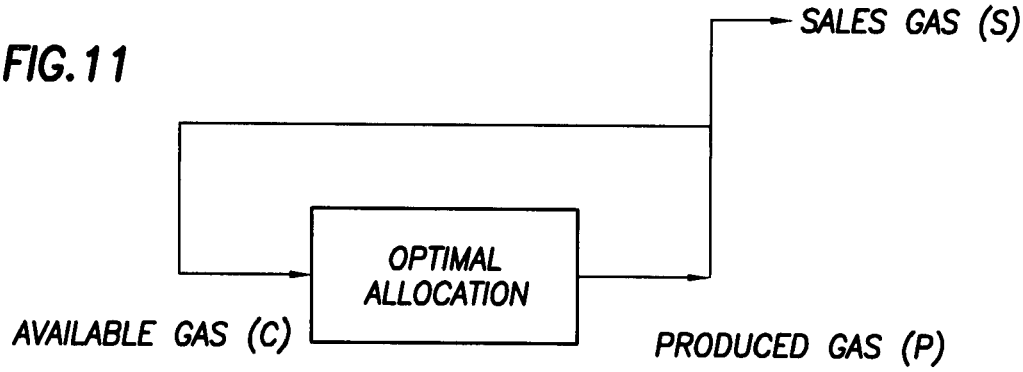
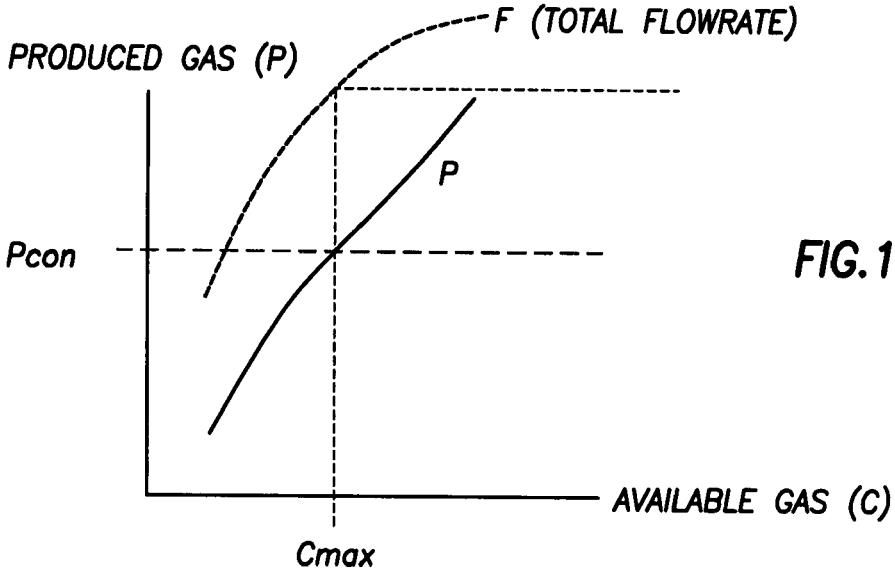
FIG. 12
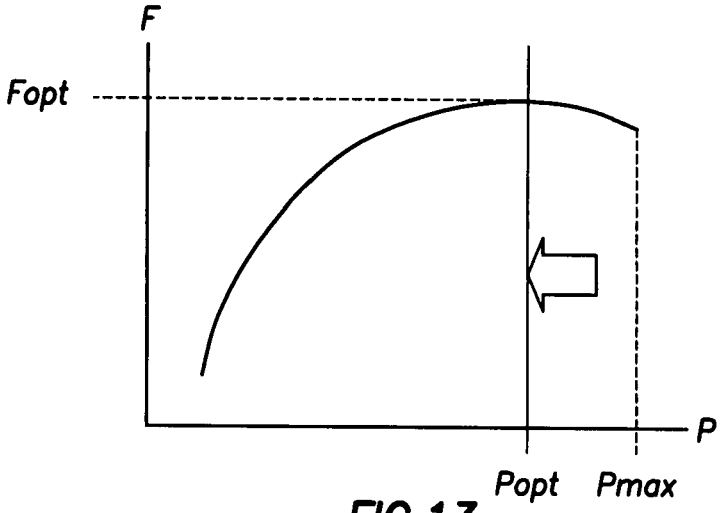
FIG. 13

METHOD FOR OPTIMAL LIFT GAS ALLOCATION

CROSS REFERENCE TO RELATED APPLICATIONS

This is a Utility Application of prior pending Provisional Application Ser. No. 60/873,429, filed Dec. 7, 2006, entitled "A method for optimal lift gas allocation and other production optimization scenarios".

BACKGROUND

This subject matter relates to a software system, including an associated method and system and computer program and program storage device, adapted to be stored in a computer system adapted for practicing a method for optimally allocating lift gas under a total lift gas constraint or a total produced gas constraint.

A gas-lift well network is constrained by the amount of gas available for injection or at other times the total amount of produced gas permissible during production due to separator constraints. Under either of these constraints, it is necessary for engineers to optimally allocate the lift gas amongst the wells so as to maximize the oil production rate.

SUMMARY

One aspect of the present invention involves a method for optimal lift gas allocation, comprising: optimally allocating lift gas under a total lift gas constraint or a total produced gas constraint, the allocating step including distributing lift gas among all gas lifted wells in a network so as to maximize a liquid or oil rate at a sink.

A further aspect of the present invention involves a method for optimal lift gas allocation, comprising: optimally allocating lift gas under a total lift gas constraint or a total produced gas constraint, the allocating step including distributing lift gas among all gas lifted wells in a network so as to maximize a liquid or oil rate at a sink, the allocating step comprising: using lift curve data generated at a pre-processing step to solve lift gas allocation; using Newton decomposition to convert N-wells and linear inequality into one of a single variable with a linear equality constraint, and running a network simulator to determine if a solution is in agreement with an actual network model for the wellhead pressures at each well.

A further aspect of the present invention involves a method for optimal lift gas allocation, comprising: optimally allocating lift gas under a total lift gas constraint or a total produced gas constraint, the allocating step including distributing lift gas among all gas lifted wells in a network so as to maximize a liquid or oil rate at a sink, a network model including a plurality of wells, the allocating step including: (a) in a pre-processing step, generating a plurality of lift performance curves for each well in the network adapted for describing an expected liquid flowrate for a given amount of gas injection at given wellhead pressures; (b) assigning for each well in the network an initial wellhead pressure ($P_s$) adapted for setting an operating curve for the each well; (c) in response to the initial wellhead pressure ($P_s$) assigned to each well in the network, implementing an allocation procedure including optimally allocating a lift gas ($\hat{L}$) among N-wells according to a total lift gas constraint (C) so as to maximize a total flow rate ($F_{RND}$); (d) on the condition that the allocation procedure is completed, calling the real network model with the optimal lift gas values ($\hat{L}$) assigned to the wells of the of the network model; and (e) repeating steps (a) through (d) until there is convergence between old estimates and new estimates of the wellhead pressure for all of the wells in the network model.

A further aspect of the present invention involves a computer program adapted to be executed by a processor, the computer program, when executed by the processor, conducting a process for optimal lift gas allocation, the process comprising: optimally allocating lift gas under a total lift gas constraint or a total produced gas constraint, the allocating step including distributing lift gas among all gas lifted wells in a network so as to maximize a liquid or oil rate at a sink.

A further aspect of the present invention involves a computer program adapted to be executed by a processor, the computer program, when executed by the processor, conducting a process for optimal lift gas allocation, the process comprising: optimally allocating lift gas under a total lift gas constraint or a total produced gas constraint, the allocating step including distributing lift gas among all gas lifted wells in a network so as to maximize a liquid or oil rate at a sink, the allocating step comprising: using lift curve data generated at a pre-processing step to solve lift gas allocation; using Newton decomposition to convert N-wells and linear inequality into one of a single variable with a linear equality constraint, and running a network simulator to determine if a solution is in agreement with an actual network model for the wellhead pressures at each well.

A further aspect of the present invention involves a computer program adapted to be executed by a processor, the computer program, when executed by the processor, conducting a process for optimal lift gas allocation, the process comprising: optimally allocating lift gas under a total lift gas constraint or a total produced gas constraint, the allocating step including distributing lift gas among all gas lifted wells in a network so as to maximize a liquid or oil rate at a sink, a network model including a plurality of wells, the allocating step including: (a) in a pre-processing step, generating a plurality of lift performance curves for each well in the network adapted for describing an expected liquid flowrate for a given amount of gas injection at given wellhead pressures; (b) assigning for each well in the network an initial wellhead pressure ($P_s$) adapted for setting an operating curve for the each well; (c) in response to the initial wellhead pressure ($P_s$) assigned to each well in the network, implementing an allocation procedure including optimally allocating a lift gas ($\hat{L}$) among N-wells according to a total lift gas constraint (C) so as to maximize a total flow rate ($F_{RND}$); (d) on the condition that the allocation procedure is completed, calling the real network model with the optimal lift gas values ($\hat{L}$) assigned to the wells of the of the network model; and (e) repeating steps (a) through (d) until there is convergence between old estimates and new estimates of the wellhead pressure for all of the wells in the network model.

A further aspect of the present invention involves a program storage device readable by a machine tangibly embodying a program of instructions executable by the machine to perform method steps for optimal lift gas allocation, the method steps comprising: optimally allocating lift gas under a total lift gas constraint or a total produced gas constraint, the allocating step including distributing lift gas among all gas lifted wells in a network so as to maximize a liquid or oil rate at a sink.

A further aspect of the present invention involves a system adapted for optimal lift gas allocation, comprising: apparatus adapted for optimally allocating lift gas under a total lift gas constraint or a total produced gas constraint, the apparatus including further apparatus adapted for distributing lift gas among all gas lifted wells in a network so as to maximize a liquid or oil rate at a sink.

Further scope of applicability will become apparent from the detailed description presented hereinafter. It should be understood, however, that the detailed description and the specific examples set forth below are given by way of illustration only, since various changes and modifications within the spirit and scope of the 'method for optimally allocating lift gas', as described and claimed in this specification, will become obvious to one skilled in the art from a reading of the following detailed description.

BRIEF DESCRIPTION OF THE DRAWINGS

A full understanding will be obtained from the detailed description presented hereinbelow, and the accompanying drawings which are given by way of illustration only and are not intended to be limitative to any extent, and wherein:

FIG. 11 illustrates a gas lift network;

FIG. 12 illustrates the total produced gas residual formation;

FIG. 13 illustrates the variation in total flowrate (F) with the gas produced (P);

DESCRIPTION

A gas-lift well network is constrained by the amount of gas available for injection or at other times the total amount of produced gas permissible during production due to separator constraints. Under either of these constraints it is necessary for engineers to optimally allocate the lift gas amongst the wells so as to maximize the oil production rate. This is a real world scenario often modeled in network simulators, such as 'PipeSim', which is owned and operated by Schlumberger Technology Corporation of Houston, Tex.

Figure 1:
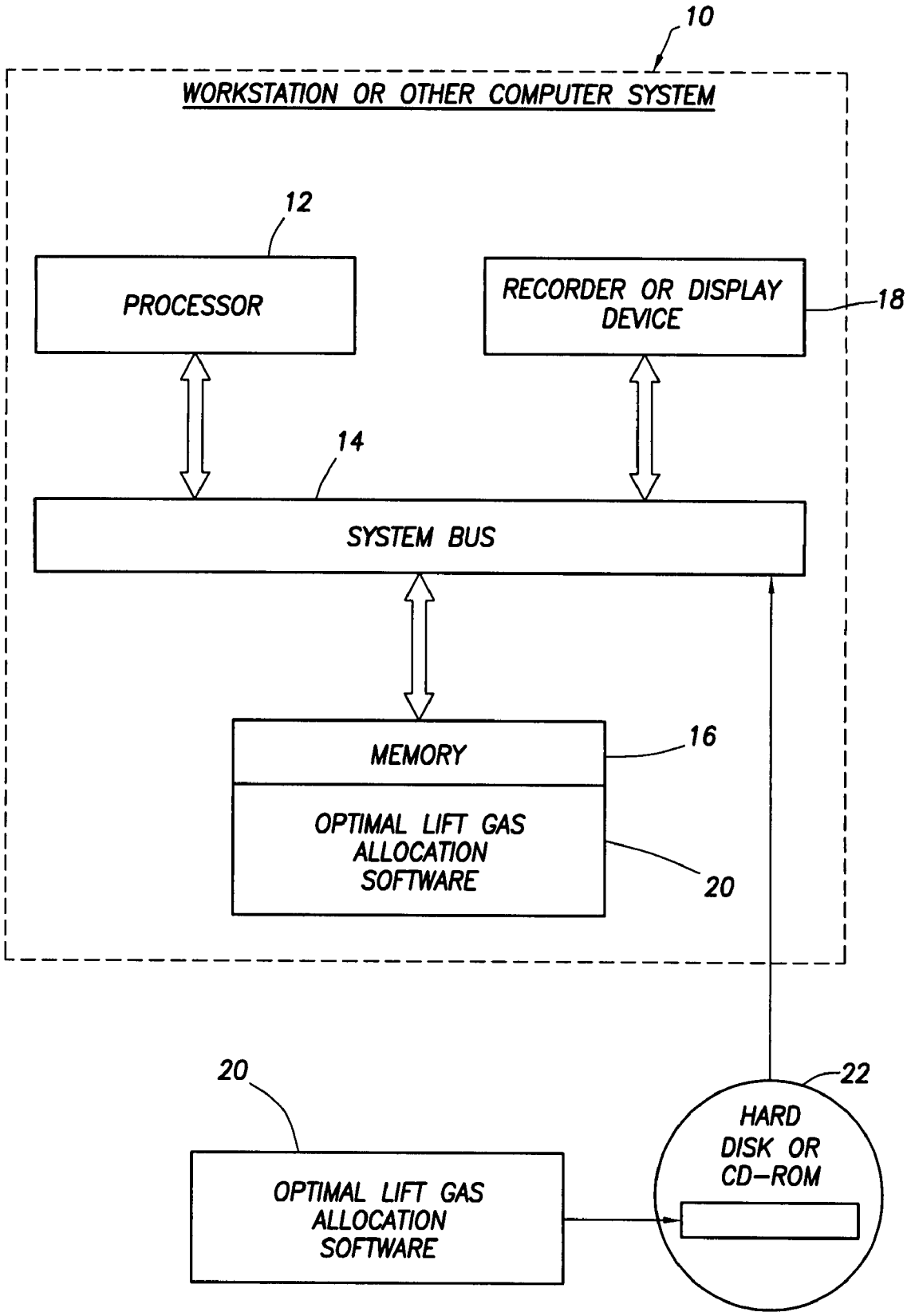
FIG. 1 illustrates a workstation or other computer system that stores an Optimal Lift Gas Allocation software disclosed in this specification.
Figure 3:
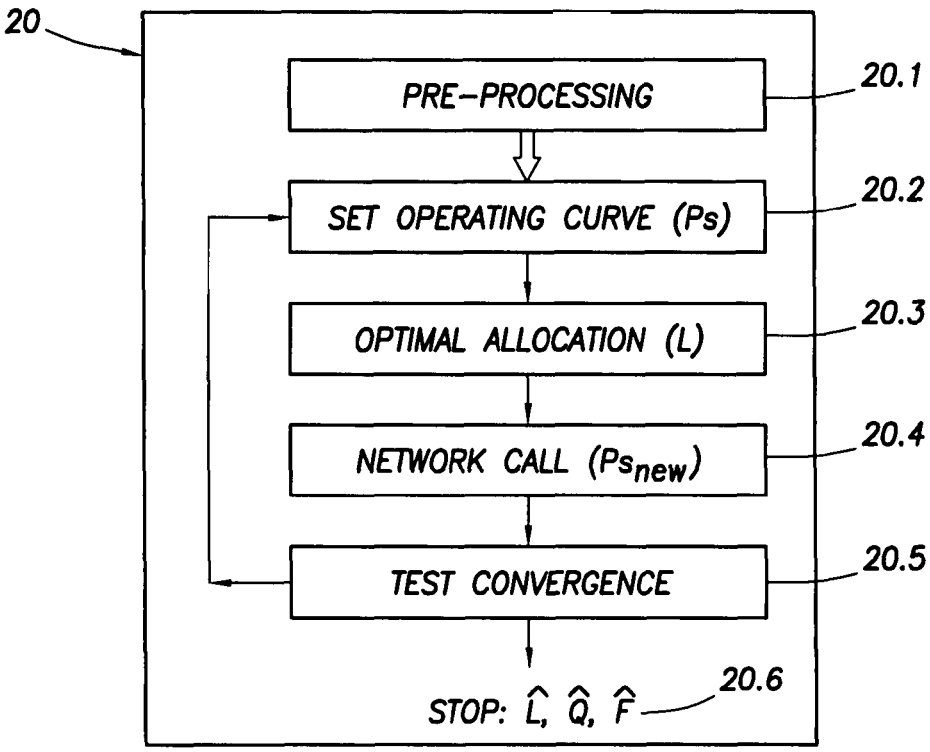
FIG. 3 illustrates a flowchart of the Optimal Lift Gas Allocation software.

The 'method for optimal lift gas allocation' described in this specification is practiced by an 'Optimal Lift Gas Allocation software' 20 that is illustrated in FIGS. 1 and 3. The 'method for optimal lift gas allocation' serves to allocate lift gas under the total lift gas constraint or the total produced gas constraint, optimally. In either case the 'method for optimal lift gas allocation' distributes the lift gas among all the gas-lifted wells in the network so as to maximize the liquid or oil rate at the sink. One construction of the 'Optimal Lift Gas Allocation software' 20 of FIG. 1 is shown in FIG. 3. The construction of the 'Optimal Lift Gas Allocation software' 20 of FIG. 3 includes an 'offline-online optimization procedure' which makes use of pre-generated lift performance curves, in a pre-processing step (step 20.1 of FIG. 3). The 'offline' problem can be solved with any suitable Non-Linear Program (NLP) solver in order to solve the n-variable, inequality constrained problem. In addition, the 'Optimal Lift Gas Allocation software' 20 of FIG. 3 uses a novel 'Newton-decomposition approach', during step 20.3 of FIG. 3, to solve the 'offline' problem. This results in a problem of a single variable with a linear equality constraint. In FIG. 3, any network simulator (other than the 'PipeSim' network simulator owned and operated by Schlumberger Technology Corporation of Houston, Tex.) can be employed to generate curves or to run the network for the 'online' solution using the lift gas allocations from the 'offline' solution, if desired.

Importantly, the 'method for optimal lift gas allocation' is equally applicable to the allocation of power for electric submersible pump (ESP) lifted wells and further can be used to control down-hole choke settings and the optimal injection of chemicals, such as methanol for stimulation, in order to maximize the level of production. Indeed, the 'method for optimal lift gas allocation' can treat a mixed network comprising any of the aforementioned items, for example, a network containing both gas and ESP lifted wells.

A gas-lift network model in 'PipeSim' comprises a topological description of the network, the boundary constraints at sources and sinks, the compositions of the fluids in the wells, the flow correlations employed and the level of gas injected into the wells. The latter can be considered as control variables, while all other elements can be deemed constant (network parameters), with respect to the optimization of production (liquid or oil rate) at the sink node in a gas-lift optimization scenario.

For a network with N-wells, the intent is to optimally allocate a fixed amount of gas C, such that the production at the sink $F_{nw}$ is maximized.

See equation (1) set forth below, which will be referenced later in this specification, as follows:

$$\text{maximize } F_{nw} = PSim(L;\ \text{network parameters}) \tag{1}$$

$$\text{such that } \sum_{i=1}^{N} L_i \leq C$$

$$\text{where: } L \in R^N$$

where, L describes the vector (size N) of gas-lift rates in the wells.

The allocation of a fixed amount of lift gas amongst N-wells is a non-linear constrained optimization problem, with the objective to maximize the production rate at the sink. There are three (3) ways to tackle this optimization problem: Directly, Indirectly or using a Simplified Approach, as discussed below.

(1) Direct optimization refers to the use of a standard Non-Linear Program (NLP) solver, such as the sequential quadratic programming method (SQP) or the augmented Lagrangian method (ALM), on the real objective function (1), where each function evaluation is a call to the network simulator. If the number of variables (the wells) are great and the simulation is expensive to run, this approach can be time consuming and computationally costly. Solvers in this class often require derivatives and can only guarantee finding the local optimum given the starting conditions specified.

This approach is available through the use of Schlumberger's 'Avocet Integrated Asset Management tool (IAM)' via the process plant simulator 'Hysys' and also through the Schlumberger Doll Research (SDR) 'Optimization Library' amongst others. The term 'Schlumberger' refers to Schlumberger Technology Corporation of Houston, Tex. Additionally, Schlumberger's numerical reservoir simulator application, Eclipse, also contains a lift-gas allocation optimizer. This however is based on a heuristic allocation procedure which involves discretizing the lift gas available and moving the smaller units to wells with increasing incremental production gradients. The allocation procedure is completed when a stable state is reached in each of the wells. Finally, it is worth noting that Petroleum Expert's GAP application employs the SQP solver.

(2) Indirect optimization refers to the application of a standard NLP solver not on the real objective function but on an approximation of it. This is achieved by sampling the real function over the domain of interest and creating a response surface, using a neural net (NN) for example, on which the optimizer is employed. If the response surface is of sufficient quality and sequentially updated with results from the real function, a near optimal solution can be obtained in place of optimizing the actual function at much reduced cost. This approach is made available in the SDR Optimization Library using the NN-Amoeba optimizer. The Amoeba refers to a modified version of Nelder and Mead's Downhill Simplex algorithm.

(3) The simplified approach is to replace the original complicated model or problem with one which is more tractable and easier to solve. This simplification evidently introduces a certain amount of model error, however it is assumed justifiable with respect to the availability and speed of solution. For the gas lift allocation problem, Schlumberger has an application called Goal. This uses a simplified representation of the real network problem (uses black oil compositions only) and works on a collection of lift performance curves using a heuristic approach. It has the advantage of being robust and providing a fast solution. The downside however is that the network must be simplified and re-created specifically in Goal. Additionally, testing has shown that an optimal solution is not guaranteed. This problem will be compounded with large scale networks (100+wells).

Referring to FIG. 1, a workstation or other computer system is illustrated which stores the 'Optimal Lift Gas Allocation Software' that is disclosed in this specification.

Figure 2:
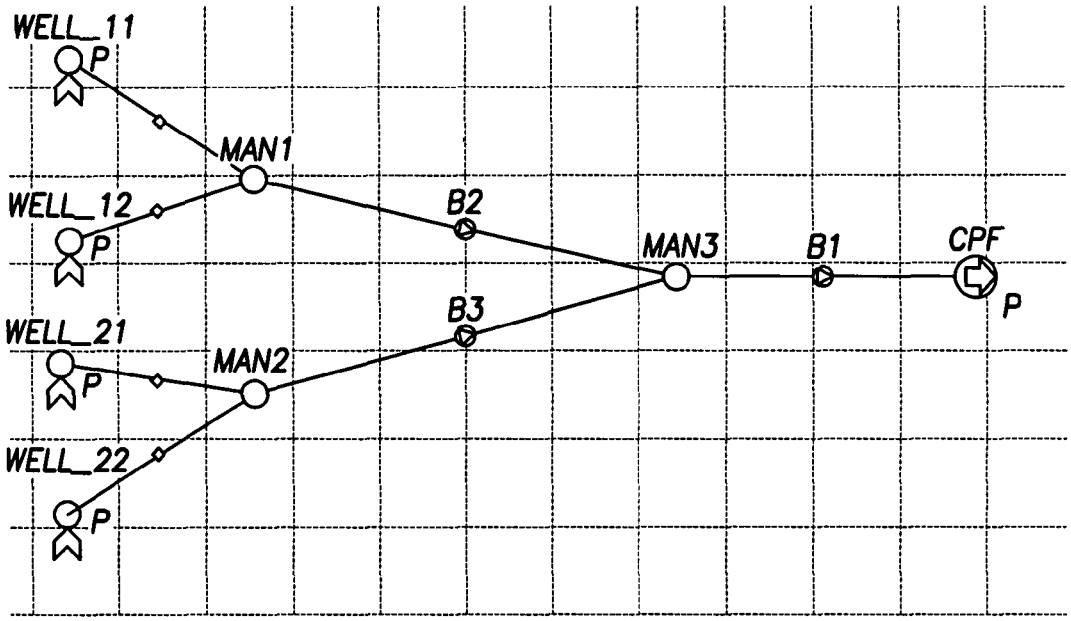
FIG. 2 illustrates a network model comprising a gas lift network with 4 wells.

In FIG. 1, a workstation, personal computer, or other computer system 10 is illustrated adapted for storing an 'Optimal Lift Gas Allocation Software'. The computer system 10 of FIG. 1 includes a Processor 12 operatively connected to a system bus 14, a memory or other program storage device 16 operatively connected to the system bus 14, and a recorder or display device 18 operatively connected to the system bus 14. The memory or other program storage device 16 stores the 'Optimal Lift Gas Allocation Software' 20 that practices an 'allocation' method adapted for 'optimally allocating lift gas under a total lift gas constraint or a total produced gas constraint' as disclosed in this specification (hereinafter called a 'method for optimal lift gas allocation'). The 'Optimal Lift Gas Allocation Software' 20, which is stored in the memory 16 of FIG. 1, can be initially stored on a Hard Disk or CD-Rom 22, where the Hard Disk or CD-Rom 22 is also a 'program storage device'. The CD-Rom 22 can be inserted into the computer system 10, and the 'Optimal Lift Gas Allocation Software' 20 can be loaded from the CD-Rom 22 and into the memory/program storage device 16 of the computer system 10 of FIG. 1. The Processor 12 will execute the 'Optimal Lift Gas Allocation Software' 20 that is stored in memory 16 of FIG. 1; and, responsive thereto, the Processor 12 will distribute the lift gas among all the gas-lifted wells in a network model (as shown in FIG. 2) so as to maximize the liquid or oil rate at the sink. The computer system 10 of FIG. 1 may be a personal computer (PC), a workstation, a microprocessor, or a mainframe. Examples of possible workstations include a Silicon Graphics Indigo 2 workstation or a Sun SPARC workstation or a Sun ULTRA workstation or a Sun BLADE workstation. The memory or program storage device 16 (including the above referenced Hard Disk or CD-Rom 22) is a 'computer readable medium' or a 'program storage device' which is readable by a machine, such as the processor 12. The processor 12 may be, for example, a microprocessor, microcontroller, or a mainframe or workstation processor. The memory or program storage device 16, which stores the 'Optimal Lift Gas Allocation Software' 20, may be, for example, a hard disk, ROM, CD-ROM, DRAM, or other RAM, flash memory, magnetic storage, optical storage, registers, or other volatile and/or non-volatile memory.

Referring to FIG. 2, a network model comprising a 'gas lift network' with four (4) wells is illustrated, where the four wells include: 'well_11', 'well_12', 'well_21', and 'well_22'. In FIG. 2, the method disclosed in this specification anticipates the availability of a network model in 'PipeSim' (referenced above), such as the network model illustrated in FIG. 2. Recall that 'PipeSim' is a network simulator that is owned and operated by Schlumberger Technology Corporation of Houston, Tex. The network model illustrated in FIG. 2 will describe the network topology and define the wells under lift, chokes or stimulation. The method for optimizing this production scenario is able to deal with a network comprising any of the above items, given a fixed amount of lift-gas, power, stimulating agent or the sum of normalized orifice values for each choke employed. However, for the purposes of this specification, a 'gas-lift network' will be considered, with the understanding that the method described herein applies equally to the other elements described or indeed mixed networks.

Figure 7:
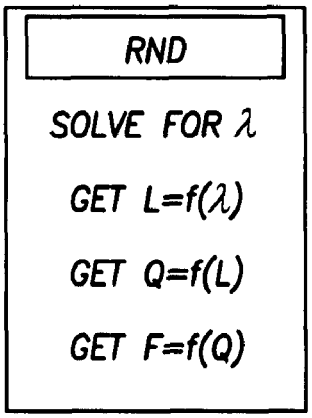
FIG. 7 illustrates a more detailed construction of step 20.3 of FIG. 3.

The 'Optimal Lift Gas Allocation software' 20 of FIG. 1 practices a 'method for optimal lift gas allocation', the 'method for optimal lift gas allocation' being disclosed in this specification. The 'method for optimal lift gas allocation' disclosed in this specification: (1) uses lift curve data generated at a pre-processing step, as shown in step 20.1 in FIG. 3, to solve the lift gas allocation problem offline, (2) uses a novel development of the 'Rashid's Newton Decomposition (RND)' (as shown in FIG. 7) during the 'optimal allocation' step 20.3 of FIG. 3 to convert the original problem of N-wells and a linear inequality into one of a single variable with a linear equality constraint, and then (3) runs the network simulator 'PipeSim' (which is owned and operated by Schlumberger Technology Corporation of Houston, Tex.) to determine if the solution is in agreement with the actual network model for the wellhead pressures of each well. In addition, the 'method for optimal lift gas allocation' disclosed in this specification has the advantage of being fast, accurate, and providing an optimal solution since it uses the 'real network model' of FIG. 2 and it significantly reduces the number of function evaluations of the simulator (PipeSim) in comparison to the 'direct optimization' method mentioned above. Hence, the 'method for optimal lift gas allocation' disclosed in this specification has the advantage of being a 'simplified approach' which has the accuracy of a solution gained from 'Direct Optimization' previously discussed. Results have been successfully obtained on networks with up to 100 wells and validated with conventional approaches.

Accordingly, the 'method for optimal lift gas allocation', that is disclosed in this specification, is practiced by the 'Optimal Lift Gas Allocation software' 20 stored in the memory 16 of FIG. 1. One construction of the 'Optimal Lift Gas Allocation software' 20 of FIG. 1 is illustrated in FIG. 3. As a result, the construction of the 'Optimal Lift Gas Allocation software' 20 of FIG. 1 will be discussed in detail in the following paragraphs of this specification with reference to FIG. 3.

Referring to FIG. 3, a flowchart of the Optimal Lift Gas Allocation software 20 of FIG. 1 is illustrated.

In FIG. 3, the 'method for optimal lift gas allocation' practiced by the 'Optimal Lift Gas Allocation software' 20 of FIGS. 1 and 3 uses an 'offline-online optimization procedure'. That is, following the extraction of 'lift performance curves', an 'offline optimization problem' is given by equation (2) and equation (3) set forth below. When the 'optimal allocation' of gas-lift rates ($\hat{L}$) have been obtained offline, the 'real network problem' is solved using equation (1), set forth above, using the 'optimal allocation' of gas-lift rates ($\hat{L}$) to thereby obtain the 'production value at the sink' ($F_{nw}$) along with the 'updated well head pressures' at each of the wells ($P_s$). The 'offline optimal allocation procedure' is then repeated by using equation (2), set forth below, and using the 'updated well head pressures' ($P_s$)

Equation (2) is set forth below, as follows:

$$\text{maximize } F_{RND} = \text{offline}(L; P_S) \tag{2}$$

$$\text{such that } \sum_{i=1}^{N} L_i \le C$$

$$\text{where: } L \in R^N$$

More specifically, this is given by equation (3) set forth below as follows:

$$\text{maximize } F_{RND} = \sum_{i=1}^{N} Q_i \tag{3}$$

$$\text{such that } \sum_{i=1}^{N} L_i \le C$$

$$\text{where: } L \in R^N$$

where: $Q_i = f(L_i; P_s)$ describes the 'lift performance curve' for a given well head pressure.

In FIG. 3, the 'method for optimal lift gas allocation' disclosed in this specification and practiced by the 'Optimal Lift Gas Allocation software' 20 of FIGS. 1 and 3 is given in algorithm form in FIG. 3 for the 'total gas available' constraint.

Figure 4:
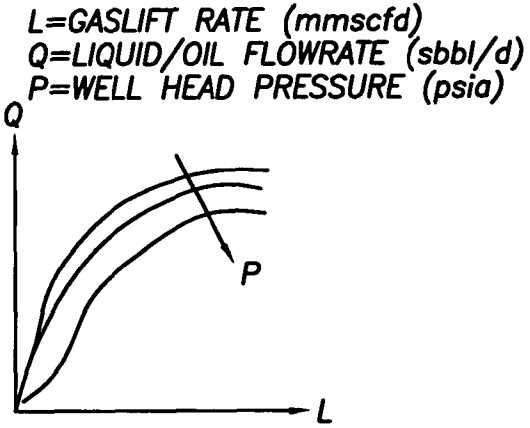
FIG. 4 illustrates lift performance curves.

Referring to FIGS. 2, 3, and 4, a 'network model' comprising a gas lift network with four (4) wells is illustrated in FIG. 2, a flowchart of the 'Optimal Lift Gas Allocation software' 20 of FIG. 1 is illustrated in FIG. 3, and a family of lift performance curves is illustrated in FIG. 4.

Step 20.1 of FIG. 3—Pre-Processing

In FIGS. 3 and 4, in the pre-processing step (20.1) of FIG. 3, referring to FIG. 4, a family of lift performance curves of FIG. 4 are generated for each well (that is, 'well_11', 'well_12', 'well_21', and 'well_22') in the 'network model' of FIG. 2. These describe the expected liquid flowrate for a given amount of gas injection at given wellhead pressures. For ESP wells, this would be 'flowrate versus horsepower'; for chokes, 'flowrate versus deltaP'; and for stimulation, 'flowrate versus methanol injection rate'. The 'pre-processing' step 20.1 of FIG. 3 is completed using 'PipeSim' or some other network simulator (or, another example of a network simulator would be 'Prosper/GAP' by Petroleum Experts).

Note that the x-axis values are common over all wells and that they are normalized. This allows the solution of mixed networks, though each lift type is effectively treated as a sub-problem. That is, for example, all gas-lift wells are solved for the gas available and all ESP wells are solved for the power available. The constraint value is also normalized as a result.

Step 20.2 of FIG. 3—Set Operating Curve

In FIG. 3, when the 'pre-processing' step 20.1 is completed, in the 'Set Operating Curves (Ps)' step 20.2, each well is assigned an initial wellhead pressure (Ps). This sets the operating curve for the well: [flowrate (Q) v liftgas (L); at a given (Ps)]. At subsequent iterations, the updated wellhead pressure obtained in the 'Network Call' step 20.4 is set. If the desired wellhead pressure does not match the family of curves stored, it is generated by interpolation.

Step 20.3 of FIG. 3—Optimal Allocation

In FIG. 3, in the 'Optimal Allocation ($\hat{L}$)' step 20.3 of FIG. 3, the lift gas (L) is optimally allocated among the 'N-wells' of the 'network model' of FIG. 2 (that is, 'well_11', 'well_12', 'well_21', and 'well_22' of FIG. 2) according to the 'total lift gas constraint' (C) so as to maximize the total flow rate ($F_{RND}$), given by equations (2) and (3) set forth above. This is a constrained non-linear problem and will typically be solved using a Sequential Quadratic Programming (SQP) solver or an Augmented Lagrangian approach (ALM).

The 'method for optimal lift gas allocation' practiced by the 'Optimal Lift Gas Allocation software' 20 of FIGS. 1 and 3 disclosed in this specification differs from any standard approaches for the treatment of equation (2) by the following.

Firstly, and non-trivially, the problem is converted to one of a single variable and secondly, the problem is solved directly using Newton's method. This decomposition ensues from the treatment of the constraint as an equality, along with the formation and use of the inverse derivative curves in order to solve the KKT conditions for optimality directly. Hence the method is referred to as Rashid's Newton Decomposition (RND).

For example, the augmented penalty function is given by equation (4), as follows:

$$\text{minimize } M(L, \lambda) = -F_{RND} + \lambda\left\{\max\left\{0, \left(\sum_{i=1}^{N} L_i - C\right)\right\}\right\}^2 \tag{4}$$

$$\text{where: } L \in R^N, \lambda \in R$$

where $\lambda$ is a penalty factor. However, if it is assumed that the operator will use all the lift gas available, then the penalty function can be stated by equation (5) as follows:

$$\text{minimize } M(L, \lambda) = -F_{RND} + \lambda\left(\sum_{i=1}^{N} L_i - C\right) \tag{5}$$

$$\text{where: } L \in R^N, \lambda \in R$$

Impose the KKT optimality conditions in equations (6) and (7), as follows:

$$\frac{\partial M}{\partial L_i} = -\frac{\partial Q_i}{\partial L_i} + \lambda = 0 \tag{6}$$

hence: $\frac{\partial Q_i}{\partial L_i} = \lambda$ where: $Q_i = f(L_i; P_S)$ $$\frac{\partial M}{\partial \lambda} = \sum_{i=1}^{N} L_i - C = 0 \tag{7}$$

hence: $\sum_{i=1}^{N} L_i = C$ where equation (7) simply treats the allocated lift gas as an equality constraint with respect to the gas available, and equation (6) suggests that the slopes of the operating curves for each of the wells has the same value λ. But what value should the penalty factor λ take? If we take the derivative of the operating curve [Q v L] to give [dQdL v L], then it can be seen that λ merely indicates a derivative level. Hence λ is bound between the highest and lowest possible derivative value dQdL for all wells. If we find a level for A that also satisfies equation (7), we have a solution.

Figure 5:
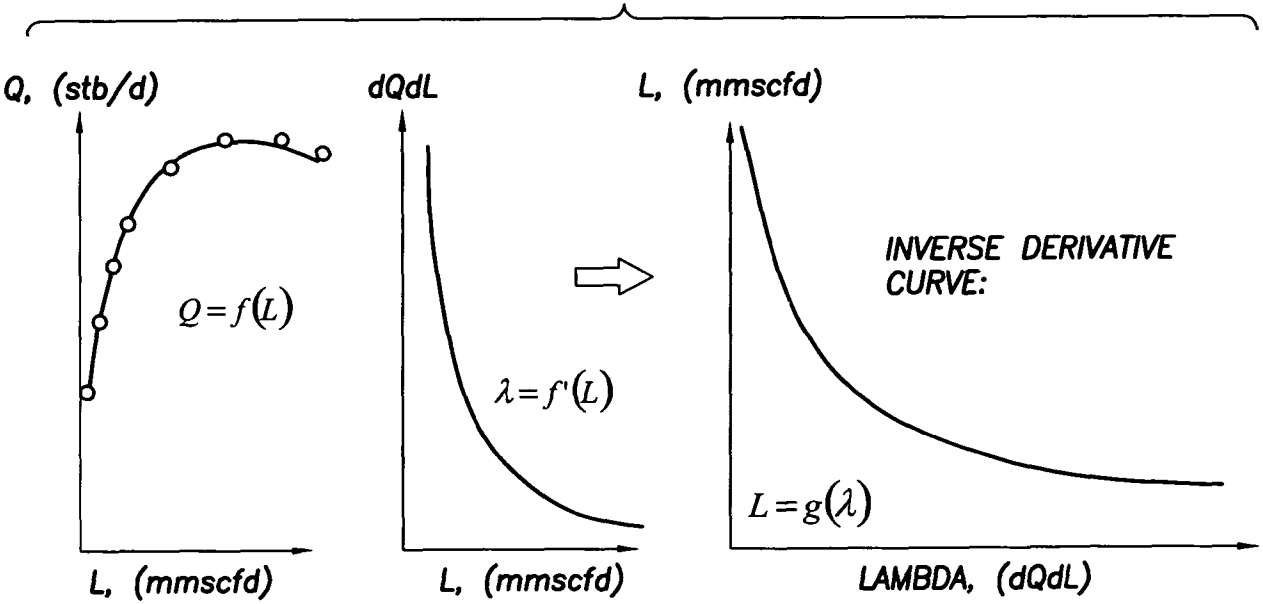
FIG. 5 illustrates forming the inverse derivative curve.

Referring to FIG. 5, this FIG. 5 illustrates the formation of the inverse derivative curve.

In FIG. 5, the important step now is to form the inverse of the derivative curve from [dQdL v L] to [L v dQdL] for each well. See FIG. 5.

If $L_i = g_i(\lambda)$, then superimposing all inverse derivative curves and summing gives:

$$E = \sum_{i=1}^{N} L_i.$$

Figure 6:
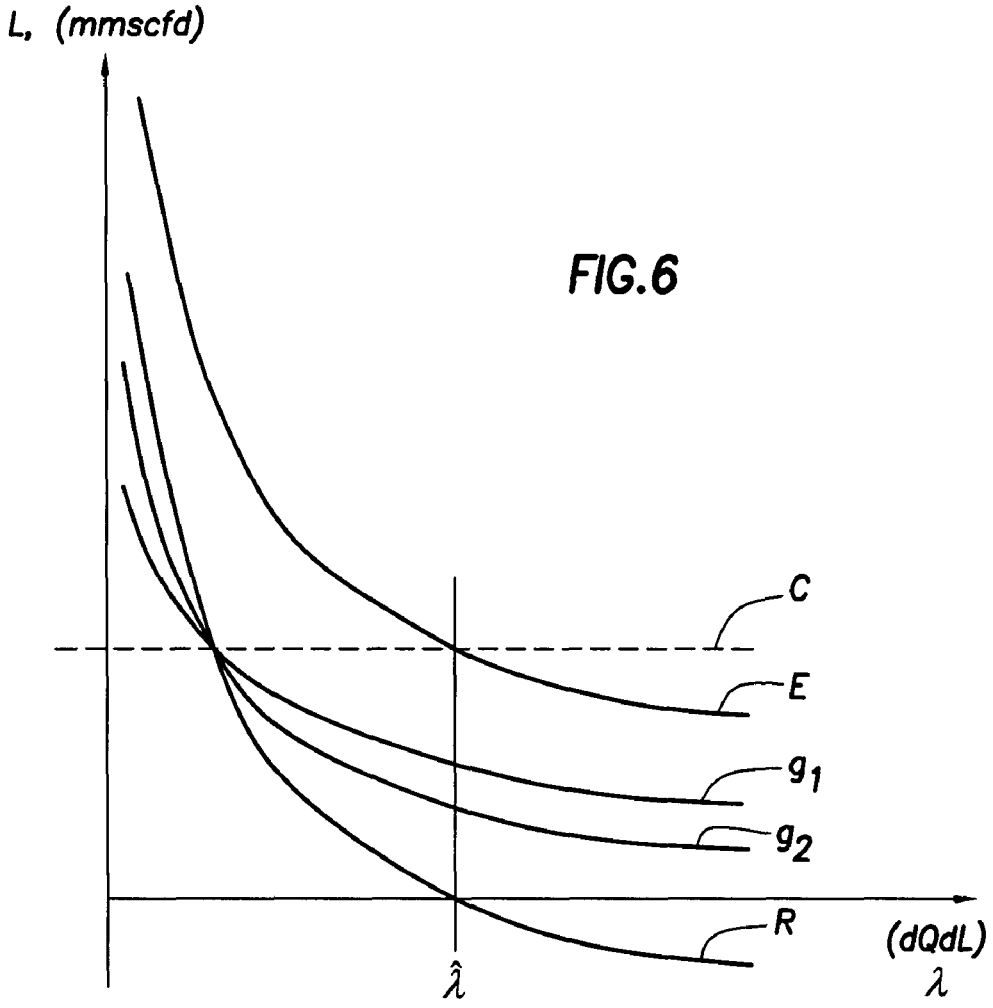
FIG. 6 illustrates solving the 1-D problem (2 well case shown)

Referring to FIG. 6, this FIG. 6 illustrates solving the 1-D problem (2 well case shown).

In FIG. 6, E is constrained by the total gas available C, therefore, in practice, E≧C. However, if we treat C as an equality constraint, under the assumption that all the available lift gas is used, we can compose a residual function, in equations (8), (9), (10), and (11), as follows:

$$R(\lambda) = E(\lambda) - C \tag{8}$$

and solve R(λ)=0 for A using Newton's method (see FIG. 6):

$$\lambda_{new} = \lambda_{old} - \frac{R(\lambda)}{R'(\lambda)} \tag{9}$$

where:

$$R(\lambda) = \sum_{i=1}^{N} g_i(\lambda) - C \tag{10}$$

and:

$$R'(\lambda) = \frac{dR}{d\lambda} = \sum_{i=1}^{N} \frac{dg_i(\lambda)}{d\lambda} \tag{11}$$

Referring to FIGS. 3 and 7, a flowchart of the Optimal Lift Gas Allocation software 20 of FIG. 1 is illustrated in FIG. 3, and a more detailed construction of the Optimal Allocation step 20.3 of FIG. 3 is illustrated in FIG. 7. In FIGS. 3 and 7, the Optimal Allocation step 20.3 in FIG. 3 can now be labeled as "Rashid's Newton Decomposition (RND)" for the solution of an N-variable linear inequality constrained non-linear problem. FIG. 7 illustrates the "Rashid's Newton Decomposition (RND)" and the solution of the N-variable linear inequality constrained non-linear problem.

Figure 8:
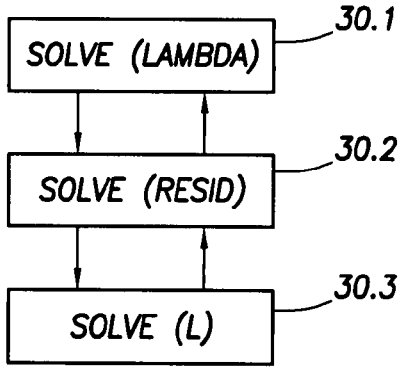
FIG. 8 illustrates a flowchart for solving for Lambda.

Referring to FIGS. 6 and 8, FIG. 6 illustrates solving the 1-D problem (2 well case shown), and FIG. 8 illustrates a flowchart for solving for Lambda. In FIGS. 6 and 8, referring to FIG. 6, a solution for 'lambda' is sought using Newton's method. The procedure, for the solution of 'lambda', is shown in FIG. 8. In FIG. 8, in connection with the 'solve (lambda)' step 30.1, initial estimates are set by default for high and low values of 'lambda'. In connection with the 'residual function' step 30.2 of FIG. 8, the residual function is 'evaluated' (step 30.2 in FIG. 8). If the bracket is not found, successive secant steps are taken until the solution is bracketed. Once the bracket is found, Newton's method is employed to isolate the solution $\hat{\lambda}$, starting initially from the mid-point of the bracket. In FIG. 8, in step 30.2, the 'residual function' (which is a function of 'lambda') is 'evaluated' by implementing step 30.3 of FIG. 8, which is the 'solve (L)' step 30.3. That is, the residual function (which is a function of 'lambda') is 'evaluated' by solving for the 'L' value on each operating curve for each well for the given lambda value (step 30.3 in FIG. 8). The 'residual function' is composed as a sum of the individual operating curves at the given 'lambda'. See equation (10) above.

Figure 9:
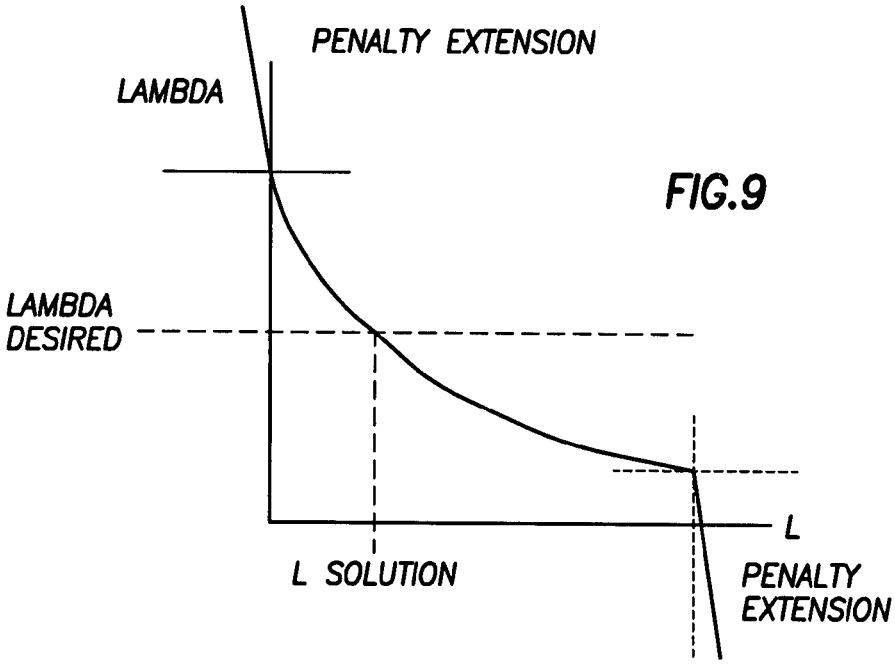
FIG. 9 illustrates solving for L given lambda desired.

Referring to FIGS. 8 and 9, FIG. 8 illustrates a flowchart for solving for 'lamdba', and FIG. 9 illustrates solving for 'L' given the desired value of 'lambda'. In FIGS. 8 and 9, in step 30.3 in FIG. 8, the monotonically decreasing derivative curve for each well is solved for the 'lift value ($L_i$)' given the desired 'lambda' value. See FIG. 9. Note the penalty line extensions which ensure that a 'lambda' solution is always returned in case of very high or negative lambda values.

In FIG. 5, it is important to note that the inverse problem (that is, solving for $L_i$ for a desired 'lambda') is solved so as to obviate the need for modeling the inverse derivative curve (function: $L_i = g_i(\lambda)$). Although this requires a greater number of function evaluations as a result, it is better than degrading the solution quality by successive curve fitting (see FIG. 5).

As the x-axis are normalized by default, the bracket is also defined by default. Hence, the bisection method is employed for several steps to reduce the size of the bracket before Newton steps are taken to convergence. This provides a computationally efficient and robust solution.

Step 20.4 of FIG. 3—Network Call

In FIG. 3, recalling that the 'allocation procedure' will generate a solution of the problem represented by equations (2) for a given set of well head pressures ($P_s$), when the 'allocation procedure' is completed and the solution of the problem represented by equations (2) for a given set of well head pressures ($P_s$) is obtained, the 'real network model' represented by equation (1) is called with the optimal lift-gas values ($\hat{L}$) assigned to the wells of the network model of FIG. 2. The production rate at the sink ($F_{RND}$) can be used to compare with the solution from the offline solution ($F_{RND}$), though primarily it is the new well-head pressures that are sought ($P_s^{new}$), as indicated by the 'Network Call ($P_s^{new}$)' step 20.4 of FIG. 3.

Step 20.5 of FIG. 3—Convergence Test

In FIG. 3, the procedure repeats until there is convergence between the old and new estimates of the well-head pressure for all the wells (step 20.5 of FIG. 3). Two tests can be made, the 'L2-norm' or the 'infinity-norm' (maximum absolute difference):

$$L_2\text{-norm } err_1=\sqrt{AA^T} \quad (12)$$

$$L_\infty\text{-norm } err_2=\max(A) \quad (13)$$

where: $A=\text{abs}\lfloor P_s^{new}-P_s \rfloor$

If the convergence test is not met, the procedure repeats by returning to step 20.2 of FIG. 3. The operating curve for each well of the network model of FIG. 2 is updated according to the 'new well head pressure'.

Step 20.6 of FIG. 3—Stop

In FIG. 3, referring to the "stop" step 20.6, once convergence has been achieved (in step 20.5 of FIG. 3), the optimal allocation vector ($\hat{L}$), the converged wellhead pressures ($\hat{P}_s$), the resulting well flowrates ($\hat{Q}$), and the total production flowrate ($\hat{F}$) are returned in step 20.6 along with other algorithm metrics.

Test Study Results

Test studies have shown that the proposed 'method for optimal lift gas allocation' requires far fewer function evaluations in comparison to direct optimization. Tables 1-3 below show results for gas lift networks comprising 2, 4 and 100 wells respectively. The proposed 'method for optimal lift gas allocation' takes less computational effort in time and the number of network simulator calls required in comparison to direct optimization and indirect optimization approaches. The use of NLP solvers (ALM and SQP) requiring numerical derivative evaluations require even greater number of function evaluations. These differences are compounded with large scale networks and the significant reduction achieved in the number of real function calls is of great value.

TABLE 1

Results for 2-well GL Network

| Allocate: 2 mmscfd | GLOPT using RND (proposed) | Amoeba (direct) | NN-Amoeba (indirect) |
|---|---|---|---|
| well-11 | 1.1010 | 1.0962 | 1.1003 |
| well-12 | 0.8990 | 0.9032 | 0.8997 |
| F (offline) | 2834.58 | — | — |
| F (online) | 2836.20 | 2837.23 | 2836.20 |
| pre-processing time (secs) | 30 | — | — |
| run-time (secs) | 12 | 42 | 36 |
| total-time (secs) | 42 | 42 | 36 |
| network calls | 3 | 20 | 14 |

TABLE 2

Results for 4-well GL Network

| Allocate: 4 mmscfd | GLOPT using RND (proposed) | Amoeba (direct) | NN-Amoeba (indirect) |
|---|---|---|---|
| well-11 | 1.1396 | 1.0739 | 1.0110 |
| well-12 | 0.9315 | 0.8170 | 0.9890 |
| well-21 | 0.7404 | 0.8246 | 0.9353 |
| well-22 | 1.1885 | 1.2846 | 1.0647 |
| F (offline) | 5743.71 | — | — |
| F (online) | 5760.08 | 5764.22 | 5750.11 |
| pre-processing time (secs) | 60 | — | — |
| run-time (secs) | 19 | 201 | 111 |
| total-time (secs) | 79 | 201 | 111 |
| network calls | 3 | 59 | 18 |

TABLE 3

Results for 100-well GL Network

| Allocate: 40 mmscfd | GLOPT using RND (proposed) | Amoeba (direct) |
|---|---|---|
| F (offline) | 30098 | — |
| F (online) | 27365 | 27438 |
| difference from Amoeba result | 0.27% | — |
| pre-processing time (mins) | 25.0 | — |
| run-time (mins) | 5.02 | 153.6 |
| total-time (mins) | 30.02 | 153.6 |
| network calls | 8 | 369 |

Additional Considerations

Optimality of the Available Gas Constraint Problem

Figure 10:
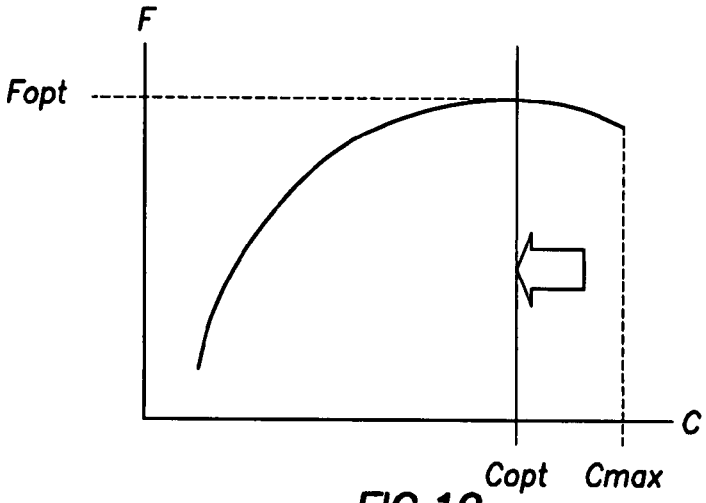
FIG. 10 illustrates the variation in total flowrate (F) with the gas available (C)

Referring to FIG. 10, the variation in total flowrate (F) with the gas available (C) is illustrated. In FIG. 10, the total gas available constraint is treated as an equality constraint. To ensure that there is no degradation in the production with this assumption (i.e. too much gas injected into the wells), it is necessary to assess the sensitivity of the total production flowrate with a reduction in the total gas available. See FIG. 10. If the derivative is negative, the constraining gas limit should be reduced so as to obtain the maximum possible production. This will be done iteratively using a suitable numerical scheme until a zero derivative is obtained, identifying the maximum production rate. If the derivative is positive, then it can be reasoned that production is maximized when all the available gas is injected.

Total Produced Gas Constraint

Referring to FIG. 11, a gas lift network is illustrated. In FIG. 11, the 'method for optimal lift gas allocation' described in this specification has dealt with the 'total gas available' constraint. The imposition of a constraint on the total produced gas (see FIG. 11) can also be handled by solving for the 'maximum produced gas possible'. The 'total gas produced' constraint is dealt with by minimizing the residual of the total amount of gas produced (P) and the constraint on the amount of gas produced ($P_{con}$). That is, $R(P)=P-P_{con}$. Evidently, if the total produced gas constraint is set as the available gas, the amount of gas produced will exceed the aforementioned constraint. This forms the right hand bracket of the residual function. A value of half the total produced gas constraint is set as the available gas for the left hand residual solution, completing the bracket for the constrained solution. A combined bisection and secant procedure is employed to reduce the bracket size and isolate the solution.

Referring to FIG. 12, the total produced gas residual formation is illustrated. In FIG. 12, convergence will yield the maximum production possible ($F_{max}$) given an optimal allocation of a given amount of gas ($C_{max}$) while meeting the total produced gas constraint ($P_{con}$). See FIG. 12. This approach can be similarly employed to treat global and sink level constraints. For example, a total liquid rate constraint at a sink or the total sum of flow-rates at the wells.

Optimality of the Produced Gas Constraint Problem

In the preceding section of this specification, the 'total gas produced' constraint is solved as an equality. It is not strictly true that maximum production arises when the 'total gas produced' constraint is met as a result of injecting the most gas possible and limiting the additional gas produced at the sink. Hence, as for the 'total available gas' constraint problem, it is necessary to assess the sensitivity of the production rate with a decrease in the 'total produced gas' constraint.

Referring to FIG. 13, the variation in total flowrate (F) with the gas produced (P) is illustrated. In FIG. 13, if the derivative is negative, a solution will be sought that maximizes the total production possible by reducing the total produced gas constraint iteratively with a suitable line search procedure. See FIG. 13. If the derivative is positive, the identified solution is the 'optimal'. That is, by producing gas at the constraint limit, the overall production is optimized.

Local Constraint Handling

The 'total available gas' constraint and the 'total produced gas' constraint are both global constraints. They act on the entire network model. Local constraints, on the other hand, are those constraints which act locally at the well level. This section of the specification describes the approach for handling local constraints on the lift performance curve of a given well. In particular, the imposition of minimum injection ($L_{min}$), minimum flowrate ($Q_{min}$), maximum injection ($L_{max}$) and maximum flowrate ($Q_{max}$) are considered. These constraints can be applied in any number or combination thereof with respect to an individual well.

The constraints are managed with two key developments. The first is 'curve shifting' in which the operating curve is shifted towards the left to account for a fixed quantity of injection. The second is 'curve modification' in which the operating curve is modified about a given control point. Invariably, this control point is the intersection of the operating curve with a linear flow rate constraint.

The four constraints can be categorized into those yielding lower operating limits (Lmin and Qmin) and those which yield upper operating limits (Lmax and Qmax). With respect to the former, the operating curve is both shifted and modified (i.e., curve shifting), while the latter undergo curve modification (i.e., curve modification) only. For multiple constraints, the precedence lies in establishing the lower limits (curve shifting) prior to applying upper constraint limits by curve modification. These elements are addressed below.

Lmin and Qmin Constraints

The application of a minimum flowrate constraint and a minimum injection constraint is resolved to the limiting case [$L_{min}$ $Q_{min}$] on the operating curve. If $L_{min}$ is the least amount of lift gas that the well can receive, the original problem is modified to one of allocating ($C_m$=C−$L_{min}$) gas, where C is the total lift gas available for injection. If $L_{min}$ is pre-allocated, the lift profile for the well starts from the point [$L_{min}$ $Q_{min}$]. Hence, the curve is re-defined with a shift to the left. The curve modification procedure is used to complete the curve over the range of the normalized axis. The decreasing nature of the modification function ensures that the flowrate obtained results from the least possible amount of injection. That is, you will never inject more gas for the same amount of production. The modification function is also selected so as to maintain the monotonicity requirement of the derivative curve.

Figure 14:
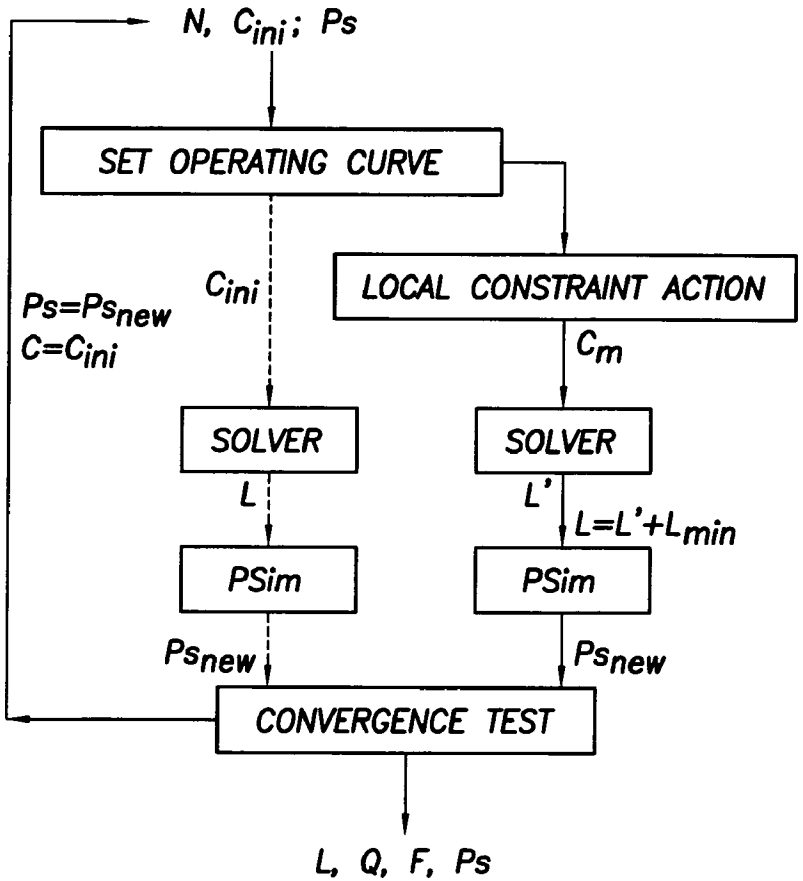
FIG. 14 illustrates local constraint handling.

Referring to FIG. 14, local constraint handling is illustrated. In FIG. 14, finally, the x-axis are 're-normalized', ranging from 0 to 1. The reduction of 'C' ensures the correct problem is solved by the solver. It is imperative to add back the $L_{min}$ component to the solution from the solver before applying the lift rate to the well in the network model. See FIG. 14 for the local constraint handling procedure.

Lmax and Qmax Constraints

Figure 15:
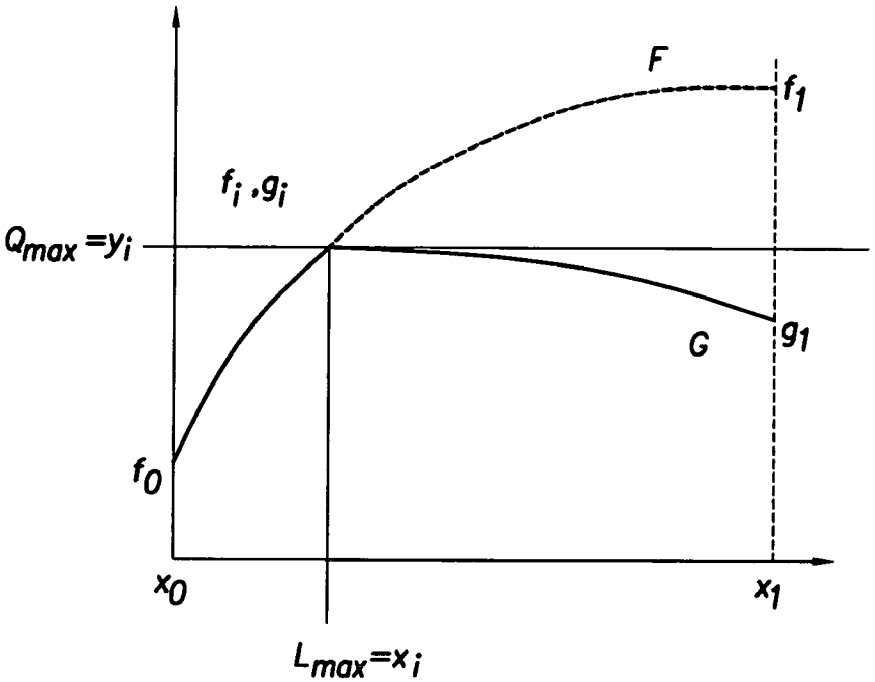
FIG. 15 illustrates curve modification.
Figure 16:
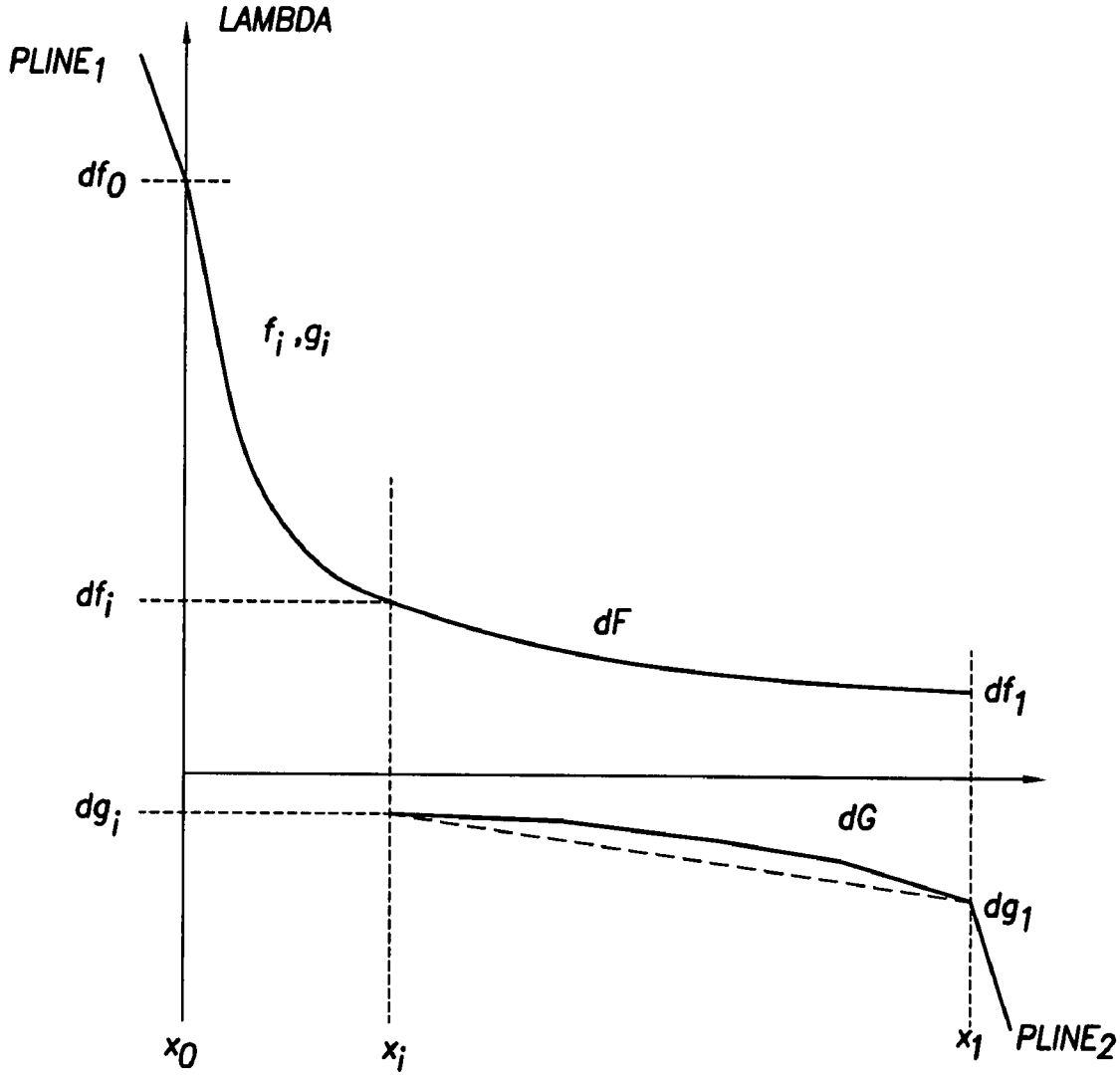
FIG. 16 illustrates solving for Lambda with curve modification.

Referring to FIGS. 14, 15, and 16, FIG. 14 illustrates local constraint handling, FIG. 15 illustrates curve modification, and FIG. 16 illustrates solving for Lambda with curve modification. In FIGS. 14, 15, and 16, the application of a 'maximum flowrate' constraint and a 'maximum injection' constraint is resolved to the limiting case [$L_{max}$ $Q_{max}$] on the operating curve. It is evident that to limit the flow rate to $Q_{max}$ the most that can be injected is $L_{max}$ and similarly to limit the well to $L_{max}$ constrains production to $Q_{max}$. Hence, the $Q_{max}$ or $L_{max}$ constraint can be handled in the same way using curve modification procedure by effectively penalizing the production rate (Q) for injection rates greater than $L_{max}$. See FIG. 15 and FIG. 16 for the effect on the derivative curve. The local constraint handling procedure is given in FIG. 14. Note however that, if $L_{min}$ and $Q_{min}$ constraints are applied, these are implemented first using curve shifting as discussed above.

Secondary or Related Constraints

Secondary constraints are those which are related to the 'lift performance curve' by some given relationship. For example, GOR and WC set as a fraction of the production liquid rate Q can be used to modify the given operating curve for $Q_{water}$, $Q_{gas}$ or $Q_{oil}$ local constraints. In this case, we can convert the problem to an equivalent $Q_{max}$, $Q_{min}$, $L_{max}$ or $L_{min}$ constrained problem as indicated above.

Zero Injection

Remove the well from the allocation problem. Solve the sub-problem of M-wells, where (M=N−1).

Shut-In Prevention

In order to prevent a well from being shut-in, set a default $Q_{min}$ local rate constraint. This could be applied at the outset or implemented as a preventative measure if PipeSim returns a shut-in well solution.

Lset Constraint

Force the well to receive Lset. Remove the well from the allocation procedure. Reduce the total gas available for allocation: $C_m$=C−$L_{set}$. Solve the sub-problem of M-wells, where (M<N).

Multiple Local Constraints

Resolve each active constraint for the most limiting case. Use curve shifting for $L_{min}$ and $Q_{min}$ type constraint. Use curve modification for $L_{max}$, and $Q_{max}$ type constraint. Use the procedure outlined above to resolve these constraints.

Auxillary Global Constraints

Global constraints acting on the sink can be handled as per the total produced gas constraint problem. A residual function is formed such that the constraint value minus the desired value is zero. A range of solutions might be required to identify the true optimum with regard to the inequality.

Tertiary Constraints

Tertiary Constraints are those which do not have a direct relationship to the lift curves, such as constraints on a manifold. These constraints can not be managed implicitly within the solver. The solver will yield a solution and the intermediary constraint can only evaluated by calling the network model. Corrective action must then be assigned for each particular type of local constraint employed. Hence the type and order of action required to resolve the constraint, such as reduction of lift gas or the use of control valves, must be defined a priori.

Manifold Liquid Rate Constraints

The original problem is solved and the manifold constraint is tested. If it is feasible no further action is required. If the constraint is active, the optimal amount of gas permissible in the sub-network containing the wells which are upstream of the manifold constraint is established. The difference between the original allocation and the optimal allocation to this sub-network is re-distributed to the remaining sub-network. The real network model is called and the manifold constraint is tested. The difference between the offline constraint active solution and the online constraint inactive solution provides a slack in the offline manifold constraint level. This manifold constraint is increased for the offline solution so as to effectively reduce the slack between the offline and online constraint level and further maximize the network production. An iterative approach is necessary for multiple manifold constraint handling. This approach requires the identification of upstream wells, which can become complicated for large looped networks.

A functional description of the operation of the Optimal Lift Gas Allocation software 20 of FIGS. 1 and 3 adapted for practicing the 'method for optimal lift gas allocation' will be set forth in the following paragraphs with reference to FIGS. 1 through 16 of the drawings.

In FIG. 1, when the processor 12 of the computer system 10 executes the Optimal Lift Gas Allocation software 20 stored in the memory 16, the processor 12 will be executing the steps 20.1, 20.2, 20.3, 20.4, 20.5, and 20.6 of FIG. 3. As a result, when the processor 12 executes steps 20.1 through 20.6 of FIG. 3, the following functional operation is performed by the computer system 10 of FIG. 1.

The processor 12 will execute the 'Optimal Lift Gas Allocation software' 20 of FIG. 3 and practice a 'method for optimal lift gas allocation' which includes optimally allocating lift gas under a total lift gas constraint or a total produced gas constraint, the allocating step including distributing lift gas among all gas lifted wells in a network so as to maximize a liquid or oil rate at a sink. One construction of the 'Optimal Lift Gas Allocation software' 20 of FIG. 1 is shown in FIG. 3. The construction of the 'Optimal Lift Gas Allocation software' 20 of FIG. 3 includes an 'offline-online optimization procedure' which makes use of pre-generated lift performance curves, in a pre-processing step (step 20.1 of FIG. 3). The 'offline' problem can be solved with any suitable Non-Linear Program (NLP) solver in order to solve the n-variable, inequality constrained problem. In addition, the 'Optimal Lift Gas Allocation software' 20 of FIG. 3 uses a novel 'Newton-decomposition approach', during step 20.3 of FIG. 3, to solve the 'offline' problem. This results in a problem of a single variable with a linear equality constraint. In FIG. 3, any network simulator (other than the 'PipeSim' network simulator owned and operated by Schlumberger Technology Corporation of Houston, Tex.) can be employed to generate curves or to run the network for the 'online' solution using the lift gas allocations from the 'offline' solution, if desired. The allocating step (that is, the step of 'optimally allocating lift gas under a total lift gas constraint or a total produced gas constraint') includes: using lift curve data generated at a pre-processing step to solve lift gas allocation, using Newton decomposition to convert N-wells and linear inequality into one of a single variable with a linear equality constraint, and running a network simulator to determine if a solution is in agreement with an actual network model for the wellhead pressures at each well. In particular, the allocating step (that is, the step of 'optimally allocating lift gas under a total lift gas constraint or a total produced gas constraint') further includes: using an offline-online optimization procedure, the offline-online optimization procedure including: extracting lift performance curves, solving an offline optimal allocation procedure to determine an optimal allocation of gas-lift rates ($\hat{L}$), solving a real network problem including a plurality of wells using the optimal allocation of gas-lift rates ($\hat{L}$) to obtain a production value at a sink $F_{nw}$ and updated well head pressures at each of the wells ($P_s$), and repeating the offline optimal allocation procedure using the updated well head pressures. Recalling that a fully working network model includes a plurality of wells, and referring to the steps 20.1 through 20.6 illustrated in FIG. 3, the allocating step (that is, the step of optimally allocating lift gas under a total lift gas constraint or a total produced gas constraint) further comprises: (a) in a pre-processing step, generating a plurality of lift performance curves for each well in the network adapted for describing an expected liquid flowrate for a given amount of gas injection at given wellhead pressures; (b) assigning for each well in the network an initial wellhead pressure ($P_s$) adapted for setting an operating curve for said each well; (c) in response to the initial wellhead pressure ($P_s$) assigned to each well in the network, implementing an allocation procedure including optimally allocating a lift gas ($\hat{L}$) among N-wells according to a total lift gas constraint (C) so as to maximize a total flow rate ($F_{RND}$); (d) on the condition that said allocation procedure is completed, calling the real network model with the optimal lift gas values ($\hat{L}$) assigned to the wells of the of the network model; and (e) repeating steps (a) through (d) until there is convergence between old estimates and new estimates of the wellhead pressure for all of the wells in the network model.

The above description of the 'method for 'optimally allocating lift gas under a total lift gas constraint or a total produced gas constraint' being thus described, it will be obvious that the same may be varied in many ways. Such variations are not to be regarded as a departure from the spirit and scope of the claimed method or system or program storage device or computer program, and all such modifications as would be obvious to one skilled in the art are intended to be included within the scope of the following claims.

I claim:

1. A method for optimal lift gas allocation, comprising:

optimally allocating lift gas under a total lift gas constraint or a total produced gas constraint, wherein allocating comprises distributing lift gas among all gas lifted wells in a network so as to maximize a liquid or oil rate at a sink, wherein allocating further comprises:

obtaining lift curve data comprising an operating curve for each of the gas lifted wells, taking a derivative of the operating curve to obtain a derivative curve for each of the gas lifted wells, forming an inverse of the derivative curve to obtain an inverse derivative curve for each of the gas lifted wells, summing the inverse derivative curve of all the gas lifted wells to convert a multiple variable problem with a linear inequality constraint into a single variable problem with a linear equality constraint, solving the single variable problem using the lift curve data to obtain a solution, and running a network simulator to generate a real network model for determining new wellhead pressures, wherein the new wellhead pressures are compared to previous wellhead pressures used in the solution to the single variable problem.

2. The method of claim 1, wherein the solution is an optimal allocation of gas-lift rates ($\hat{L}$) wherein running the network simulator to generate the real network model comprises using said optimal allocation of gas-lift rates ($\hat{L}$) to obtain a production value at a sink $F_{nw}$ and the new wellhead pressures at each of the gas lifted wells ($P_s$), and wherein allocating further comprises:

repeating said optimal allocation procedure using said new wellhead pressures until there is convergence between the previous wellhead pressures and the new wellhead pressures.

3. The method of claim 1, wherein allocating further comprises:

(a) generating a plurality of lift performance curves, for each of the gas lifted wells in the network, adapted for describing an expected liquid flowrate for a given amount of gas injection at given wellhead pressures;

(b) assigning, for each of the gas lifted wells in the network, an initial wellhead pressure ($P_s$) adapted for setting the operating curve for said each of the gas lifted wells;

(c) in response to the initial wellhead pressure ($P_s$) assigned to each of the gas lifted wells in the network, implementing an allocation procedure including optimally allocating a lift gas ($\hat{L}$) among N-wells according to a total lift gas constraint (C) so as to maximize a total flow rate ($F_{RND}$);

(d) on the condition that said allocation procedure is completed, running the network simulator with the optimal lift gas values ($\hat{L}$) assigned to the gas lifted wells to generate the real network model; and (e) repeating steps (a) through (d) until there is convergence between the previous wellhead pressures and the new wellhead pressures for all of the gas lifted wells in the real network model.

4. A method for optimal lift gas allocation, comprising:

optimally allocating lift gas under a total lift gas constraint or a total produced gas constraint, wherein allocating comprises distributing lift gas among all gas lifted wells in a network so as to maximize a liquid or oil rate at a sink, wherein allocating further comprises:

obtaining lift curve data comprising an operating curve for each of the gas lifted wells, taking a derivative of the operating curve to obtain a derivative curve for each of the gas lifted wells, forming an inverse of the derivative curve to obtain an inverse derivative curve for each of the gas lifted wells, summing the inverse derivative curve of all the gas lifted wells to convert a multiple variable problem with a linear inequality constraint into a single variable problem with a linear equality constraint, solving the single variable problem using the lift curve data to obtain a solution, and generating a real network model for determining new wellhead pressures based on the solution to the single variable problem, wherein the new wellhead pressures are compared to previous wellhead pressures used in the solution to the single variable problem.

5. The method of claim 4, wherein allocating further comprises:

extracting lift performance curves, solving an optimal allocation procedure to determine an optimal allocation of gas-lift rates ($\hat{L}$), using said optimal allocation of gas-lift rates ($\hat{L}$) to obtain a production value at a sink $F_{nw}$ and the updated wellhead pressures at each of the gas lifted wells ($P_s$), and repeating said optimal allocation procedure using said updated wellhead pressures until there is convergence between the previous wellhead pressures and the new wellhead pressures.

6. The method of claim 4, wherein allocating further comprises:

(a) generating a plurality of lift performance curves, for each of the gas lifted wells in the network, adapted for describing an expected liquid flowrate for a given amount of gas injection at given wellhead pressures; (b) assigning, for each of the gas lifted wells in the network, an initial wellhead pressure ($P_s$) adapted for setting the operating curve for said each of the gas lifted wells;

(c) in response to the initial wellhead pressure ($P_s$) assigned to each of the gas lifted wells in the network, implementing an allocation procedure including optimally allocating a lift gas (($\hat{L}$) among N-wells according to a total lift gas constraint (C) so as to maximize a total flow rate ($F_{RND}$);

(d) on the condition that said allocation procedure is completed, calling the real network model with the optimal lift gas values (L) assigned to the gas lifted wells of the real network model; and (e) repeating steps (a) through (d) until there is convergence between the previous wellhead pressures and the new wellhead pressures for all of the gas lifted wells in the real network model.

7. A method for optimal lift gas allocation, comprising:

optimally allocating lift gas under a total lift gas constraint or a total produced gas constraint, wherein allocating comprises distributing lift gas among all gas lifted wells in a network so as to maximize a liquid or oil rate at a sink, a network model including a plurality of wells, wherein allocating further comprises:

(a) generating a plurality of lift performance curves, for each well in the network, adapted for describing an expected liquid flowrate for a given amount of gas injection at given wellhead pressures;

(b) assigning, for each well in the network, an initial wellhead pressure ($P_s$) adapted for setting an operating curve for said each well;

(c) taking a derivative of the operating curve to determine a derivative curve for said each well;

(d) forming an inverse of the derivative curve to obtain an inverse derivative curve for said each well;

(e) summing the inverse derivative curve of all the plurality of wells to convert a multiple variable problem with a linear inequality constraint into a single variable problem with a linear equality constraint;

(f) in response to the initial wellhead pressure ($P_s$) assigned to each well in the network, implementing an allocation procedure including optimally allocating a lift gas ($\hat{L}$) among N-wells according to a total lift gas constraint (C) so as to maximize a total flow rate ($F_{RND}$) to solve the single variable problem;

(g) on the condition that said allocation procedure is completed, calling a real network model with the optimal lift gas values ($\hat{L}$) assigned to the wells of the network model to generate a new estimate of wellhead pressure for said each well; and (h) repeating steps (a) through (g) until there is convergence between the initial wellhead pressure and the new estimate of wellhead pressure for said each well in the network model.

solving the single variable problem using the lift curve data to obtain a solution, and running a network simulator to generate a real network model for determining new wellhead pressures, wherein the new wellhead pressures are compared to previous wellhead pressures used in the solution to the single variable problem.

8. A program storage device readable by a machine tangibly embodying a program of instructions executable by the machine to perform method steps for optimal lift gas allocation, said method steps comprising:

optimally allocating lift gas under a total lift gas constraint or a total produced gas constraint, wherein allocating comprises distributing lift gas among all gas lifted wells in a network so as to maximize a liquid or oil rate at a sink, wherein allocating further comprises:

obtaining lift curve data comprising an operating curve for each of the gas lifted wells, taking a derivative of the operating curve to obtain a derivative curve for each of the gas lifted wells, forming an inverse of the derivative curve to obtain an inverse derivative curve for each of the gas lifted wells, summing the inverse derivative curve of all the gas lifted wells to convert a multiple variable with a linear inequality constraint into a single variable problem with a linear equality constraint, solving the single variable problem using the lift curve data to obtain a solution, and generating a real network model for determining new wellhead pressures based on the solution to the single variable problem, wherein the new wellhead pressures are compared to previous wellhead pressures used in the solution to the single variable problem.

9. The program storage device of claim 8, wherein the allocating step further comprises:

extracting lift performance curves, solving an optimal allocation procedure to determine an optimal allocation of gas-lift rates ($\hat{L}$), using said optimal allocation of gas-lift rates ($\hat{L}$) to obtain a production value at a sink $F_{nw}$ and the updated wellhead pressures at each of the gas lifted wells ($P_s$), and repeating said optimal allocation procedure using said updated wellhead pressures until there is convergence between the previous wellhead pressures and the new wellhead pressures.

10. The program storage device of claim 8, wherein allocating further comprises:

(a) generating a plurality of lift performance curves, for each of the gas lifted wells in the network, adapted for describing an expected liquid flowrate for a given amount of gas injection at given wellhead pressures;

(b) assigning, for each of the gas lifted wells in the network, an initial wellhead pressure ($P_s$) adapted for setting the operating curve for said each of the gas lifted wells;

(c) in response to the initial wellhead pressure ($P_s$) assigned to each of the gas lifted wells in the network, implementing an allocation procedure including optimally allocating a lift gas ($\hat{L}$) among N-wells according to a total lift gas constraint (C) so as to maximize a total flow rate ($F_{RND}$);

(d) on the condition that said allocation procedure is completed, calling the real network model with the optimal lift gas values ($\hat{L}$) assigned to the gas lifted wells of the real network model; and (e) repeating steps (a) through (d) until there is convergence between the previous wellhead pressures and the new wellhead pressures for all of the gas lifted wells in the real network model.

11. A program storage device readable by a machine tangibly embodying a program of instructions executable by the machine to perform method steps for optimal lift gas allocation, said method steps comprising:

optimally allocating lift gas under a total lift gas constraint or a total produced gas constraint, wherein allocating step includes distributing lift gas among all gas lifted wells in a network so as to maximize a liquid or oil rate at a sink, a network model including a plurality of wells, wherein the allocating step further includes:

(a) generating a plurality of lift performance curves, for each well in the network, adapted for describing an expected liquid flowrate for a given amount of gas injection at given wellhead pressures;

(b) assigning, for each well in the network, an initial wellhead pressure ($P_s$) adapted for setting an operating curve for said each well;

(c) taking a derivative of the operating curve to determine a derivative curve for said each well;

(d) forming an inverse of the derivative curve to obtain an inverse derivative curve for said each well;

(e) summing the inverse derivative curve of all the plurality of wells to convert a multiple variable problem with a linear inequality constraint into a single variable problem with a linear equality constraint;

(f) in response to the initial wellhead pressure ($P_s$) assigned to each well in the network, implementing an allocation procedure including optimally allocating a lift gas ($\hat{L}$) among N-wells according to a total lift gas constraint (C) so as to maximize a total flow rate ($F_{RND}$) to solve the single variable problem;

(g) on the condition that said allocation procedure is completed, calling a real network model with the optimal lift gas values ($\hat{L}$) assigned to the wells of the network model to generate a new estimate of wellhead pressure for said each well; and (h) repeating steps (a) through (g) until there is convergence between the initial wellhead pressure and the new estimate of wellhead pressure for said each well in the network model.

12. A program storage device readable by a machine tangibly embodying a program of instructions executable by the machine to perform method steps for optimal lift gas allocation, said method steps comprising:

optimally allocating lift gas under a total lift gas constraint or a total produced gas constraint, wherein allocating comprises distributing lift gas among all gas lifted wells in a network so as to maximize a liquid or oil rate at a sink, wherein allocating further comprises:

obtaining lift curve data comprising an operating curve for each of the gas lifted wells, taking a derivative of the operating curve to obtain a derivative curve for each of the gas lifted wells, forming an inverse of the derivative curve to obtain an inverse derivative curve for each of the gas lifted wells, summing the inverse derivative curve of all the gas lifted wells to convert a multiple variable problem with a linear inequality constraint into a single variable problem with a linear equality constraint, solving the single variable problem using the lift curve data to obtain a solution, and running a network simulator to generate a real network model for determining new wellhead pressures, wherein the new wellhead pressures are compared to previous wellhead pressures used in the solution to the single variable problem.

13. The program storage device of claim 12, wherein the solution is an optimal allocation of gas-lift rates ($\hat{L}$), wherein running the network simulator to generate the real network model comprises using said optimal allocation of gas-lift rates ($\hat{L}$) to obtain a production value at a sink $F_{nw}$ and the new wellhead pressures at each of the gas lifted wells ($P_s$), and wherein allocating further comprises:

repeating said optimal allocation procedure using said new wellhead pressures until there is convergence between the previous wellhead pressures and the new wellhead pressures.

14. The program storage device of claim 12, wherein allocating further comprises:

(a) generating a plurality of lift performance curves, for each of the gas lifted wells in the network, adapted for describing an expected liquid flowrate for a given amount of gas injection at given wellhead pressures;

(b) assigning, for each of the gas lifted wells in the network, an initial wellhead pressure ($P_s$) adapted for setting the operating curve for said each of the gas lifted wells;

(c) in response to the initial wellhead pressure ($P_s$) assigned to each of the gas lifted wells in the network, implementing an allocation procedure including optimally allocating a lift gas ($\hat{L}$) among N-wells according to a total lift gas constraint (C) so as to maximize a total flow rate ($F_{RND}$);

(d) on the condition that said allocation procedure is completed, running the network simulator with the optimal lift gas values ($\hat{L}$) assigned to the gas lifted wells to generate the real network model; and (e) repeating steps (a) through (d) until there is convergence between the previous wellhead pressures and the new wellhead pressures for all of the gas lifted wells in the real network model.

15. A computer system adapted for optimal lift gas allocation, comprising:

a processor; and apparatus adapted to be executed on the processor for optimally allocating lift gas under a total lift gas constraint or a total produced gas constraint, the apparatus including further apparatus adapted to be executed on the processor for distributing lift gas among all gas lifted wells in a network so as to maximize a liquid or oil rate at a sink, wherein the allocating step further comprises:

obtaining lift curve data comprising an operating curve for each of the gas lifted wells, taking a derivative of said each operating curve to obtain a derivative curve for each of the gas lifted wells, forming an inverse of the derivative curve to obtain an inverse derivative curve for each of the gas lifted wells, summing the inverse derivative curve of all the gas lifted wells to convert a multiple variable problem with a linear inequality constraint into a single variable problem with a linear equality constraint, solving wherein the single variable problem is solved using the lift curve data to obtain a solution, and running a network simulator to generate a real network model for determining new wellhead pressures, wherein the new wellhead pressures are compared to previous wellhead pressures used in the solution to the single variable problem.

* * * * *